US007189142B2

(12) United States Patent
Da Batista

(10) Patent No.: US 7,189,142 B2
(45) Date of Patent: Mar. 13, 2007

(54) SHARPENING-TRIMMING ASSEMBLY

(76) Inventor: Damasio Da Batista, Av. Sernambetiba, 6400 Apt. 1604, Barra da Tijuca (BR)

( * ) Notice: Subject to any disclaimer, the term of this patent is extended or adjusted under 35 U.S.C. 154(b) by 0 days.

(21) Appl. No.: 11/494,895

(22) Filed: Jul. 28, 2006

(65) Prior Publication Data

US 2007/0026768 A1 Feb. 1, 2007

(30) Foreign Application Priority Data

Jul. 29, 2005 (BR) ..... 0503196

(51) Int. Cl.
*B24B 7/00* (2006.01)

(52) U.S. Cl. ..... 451/8; 451/178; 451/349; 451/358

(58) Field of Classification Search ..... 451/6, 451/8, 9, 10, 178, 179, 180, 182, 212, 213, 451/214, 224, 229, 349, 358, 259, 260, 359
See application file for complete search history.

(56) References Cited

U.S. PATENT DOCUMENTS

| | | | | |
|---|---|---|---|---|
| 2,755,075 A | | 12/1956 | McMaster et al. | |
| 2,898,709 A | | 8/1959 | Bednarski | |
| 4,471,581 A | * | 9/1984 | Bernard et al. | 451/376 |
| 5,735,732 A | | 4/1998 | Bernard | |
| 5,951,386 A | * | 9/1999 | Martin | 451/358 |
| 6,398,633 B1 | | 6/2002 | Lothe | |
| 6,875,093 B2 | * | 4/2005 | Friel et al. | 451/260 |

FOREIGN PATENT DOCUMENTS

| | | |
|---|---|---|
| BR | P10400199 | 9/2005 |
| BR | P10401928 | 1/2006 |
| BR | P10401761 | 8/2006 |
| CA | I 124 080 | 5/1982 |

* cited by examiner

*Primary Examiner*—Jacob K. Ackun Jr.
(74) *Attorney, Agent, or Firm*—Merchant & Gould P.C.

(57) ABSTRACT

The present invention relates to a sharpening-trimming assembly comprising a base (20), a casing (30) mounted on said base (20), the casing (30) having at least two insertion slots (40, 40') provided on the upper portion of the casing (30) for receiving the tool to be sharpened, a moveable rod (120) connecting the base (20) to a engine (70) by means of at least one resilient element (110, 110'), a grindstone (80) fixed to and operable by said engine (70), forming a unit moveable by the action of the moveable rod (120) and the resilient element (110, 110'), the rod being able to flex to the vertical axis thereof by the action of the resilient element (110, 110') in conjunction with the tool to be sharpened contacting the surface of the grindstone (80) upon the insertion of the tool into one of said at least two insertion slots (40, 40') of the casing (30), and the insertion slots (40, 40') having a predetermined angling for receiving the tool to be sharpened.

9 Claims, 3 Drawing Sheets

SHARPENING-TRIMMING ASSEMBLY

FIELD OF THE INVENTION

The present invention relates to sharpening and/or trimming assemblies, and more particularly to a sharpening-trimming assembly for cutting tools having a single grindstone associated with an engine and a flexible rod.

BACKGROUND OF THE INVENTION

A number of sharpening assemblies exist for sharpening or grinding knives, cutlasses, scissors and similar cutting tools. The difference between such sharpening assemblies lies in the amount of grindstones used as well as in the arrangement thereof inside the casing or container covering the sharpening assembly.

The demand for a sharpening assembly that is simple to build and use, as well as of reduced cost, has been gradually increasing in the consumer market. Examples of such sharpening assemblies are described in U.S. Pat. Nos. 2,775,075, 2,898,709, 5,735,732 and 6,398,633, Canadian Patent 1,124,080, and Brazilian Patent Applications PI 0400199-0, PI 0401761-7 e PI 0401928-8.

U.S. Pat. No. 2,775,075 shows a sharpening device having a fixed grindstone, positioned perpendicularly to the base, attached to an engine moving the same. In that patent, the grindstone is accessible from the device outer side through a sharpening V-shaped opening, which results in an extra disadvantage, since the user may inadvertently come into contact with the moving grindstone. The sharpening motion is performed in the upper portion of the casing. In the opening a V-shaped guide arrangement is provided that is responsible for keeping the tool to be sharpened at a predetermined angle to the grindstone, which entails a further drawback to the user since, with a sudden motion by the tool, the latter may move out of its ideal sharpening position.

In U.S. Pat. No. 2,898,709, a knife sharpener is described comprising a grindstone with an angled outer surface, affixed to an engine which, in turn, is attached to the base. The sharpening motion is performed in the front portion of the casing, which comprises a support on which the tool to be sharpened rests. As in the above mentioned patent, the user may inadvertently move the tool out of the ideal sharpening position and even come into contact with the grindstone during sharpening.

U.S. Pat. No. 5,735,732 shows a drill sharpener comprising a grindstone that, in this case, is positioned parallel to the sharpener base. Thus, in order to get the drill sharpened, the user couples the drill to front and side housings on the sharpener casing which have a predetermined angling for sharpening said drill.

In U.S. Pat. No. 6,398,633 B1, a two-stage knife sharpener is described comprising three fixed grindstones lying on the same plane, the central grindstone being overlapped with a portion of the other grindstones. The tool to be sharpened is then placed in the two intersections of the three grindstones mentioned above, thereby providing for the two-stage sharpening motion. In this patent, the grindstone is also in contact with the user, as in the aforementioned patents. Likewise, the present patent sharpener does not have an ideal sharpening angle, which is not ideal for an unskilled user.

Additionally, Canadian Patent 1, 124, 080 shows an electric knife sharpener comprising, as in the aforementioned patents, a grindstone fixed to the sharpener base via an engine. The upper portion of the sharpener casing has differently angled slots for sharpening the tool against the grindstone front, rear and upper portions.

The Patent Application PI 0400199-0, which belongs to the inventor of this application, shows a single grindstone sharpening assembly having a flexible rod connecting the grindstone-engine assembly to the sharpening assembly base. Such rod is attached to the assembly base, the rod being responsible for the flexing. The disadvantage of such configuration is that, depending on the assembly storage form, the weight of the engine deforms the flexible rod, and, consequently, offsets the grindstone relative to both slots of the casing. Therefore, the rod remains permanently deformed in a predetermined position, which leads to the non-utilization of the assembly.

Patent Application PI 0401761-7, also belonging to the inventor of this application, further shows an electric sharpening assembly comprising, in addition to the prior art, a guide slot (steel plate) resulting in wear, and, among other problems, the locking of the tool to be sharpened.

Finally, Patent Application PI 0401928-8, also belonging to the inventor of this application, additionally provides an electric sharpening assembly, with two adjustment bands fastened by screws that bring the tool to be sharpened towards the grindstone. Such a way of fastening makes the adjustment of the sharpening assembly by the user difficult.

SUMMARY OF THE INVENTION

The present invention concerns a sharpening-trimming assembly, the sharpening-trimming assembly having a grindstone attached to an engine that, in turn, is affixed to a flexible rod, forming an assembly, covered by a casing having slots for the insertion of the tool to be sharpened. The flexible rod is responsible for the grindstone displacement in the direction of the slots provided on opposing sides of the casing, such that, as the tool to be sharpened is inserted into one of the slots, the cutting surface of said tool will receive a small pressure, achieved by the grindstone assembly flexing, which grindstone sharpens said tool gently and evenly, in a simple operation.

It is an object of the present invention to provide a sharpening-trimming assembly having a single grindstone, connected to the base by a flexible rod, which makes the sharpening action gentle and easy.

It is another object of the present invention to provide a flexible rod for said assembly which does not deform by the continued use of the sharpening-trimming assembly.

It is another object of the present invention to provide a sharpening-trimming assembly having slots for the insertion of tools at predetermined angles so that a gentle pressure of the grindstone combined with the flexible rod acts upon the cutting surface of the tool, making the sharpening action easy and gentle for the user.

It is a further object of the present invention to provide an element that avoids the buildup of debris resulting from sharpening close to the sharpening-trimming assembly engine, which would result in the detrimental heating thereof.

It is a further advantageous object of the present invention to provide a grindstone of reduced thickness associated with to an element provided with vanes for further ventilating the sharpening-trimming assembly engine, avoiding, as mentioned earlier, the heating thereof.

It is another object of the present invention to provide a protective element within the sharpening-trimming assembly casing that provides safety upon sharpening, by avoiding the contact of the tool to be sharpened with the sharpening-trimming assembly inner elements.

It is a further object of the present invention to provide a sharpening-trimming assembly comprising a means for inverting the rotational motion of the grindstone, along with a means for indicating the direction of motion of said grindstone, in order to indicate which slot is to be used for sharpening and/or trimming the tool inserted into the assembly.

Finally, it is another object of the present invention to provide a sharpening-trimming assembly comprising modules, which allows for an easy and quick assembly of the assembly, thus eliminating elements that make the cost of the assembly high and the use of the apparatus complex.

The objects of the present invention are achieved by the provision of a sharpening-trimming assembly comprising a base, a casing mounted on said base, the casing having at least two insertion slots provided on the upper portion of the casing for receiving the tool to be sharpened and further comprising a flexible rod connecting the base to an engine by means of at least one resilient element, a grindstone fixed to and operable by said engine, forming a unit moveable by the action of both the moveable rod and the resilient element, the rod being able to flex to the vertical axis thereof by the action of the resilient element in conjunction with the tool to be sharpened contacting the grindstone surface upon the insertion of the tool into one of said at least two slots on the casing, and the insertion slots having a predetermined angling to receive the tool to be sharpened.

BRIEF DESCRIPTION OF THE DRAWINGS

The present invention will be better understood based on the following detailed description, taken in conjunction with the attached drawings, wherein.

DETAILED DESCRIPTION OF PREFERRED EMBODIMENT

Figure 1:
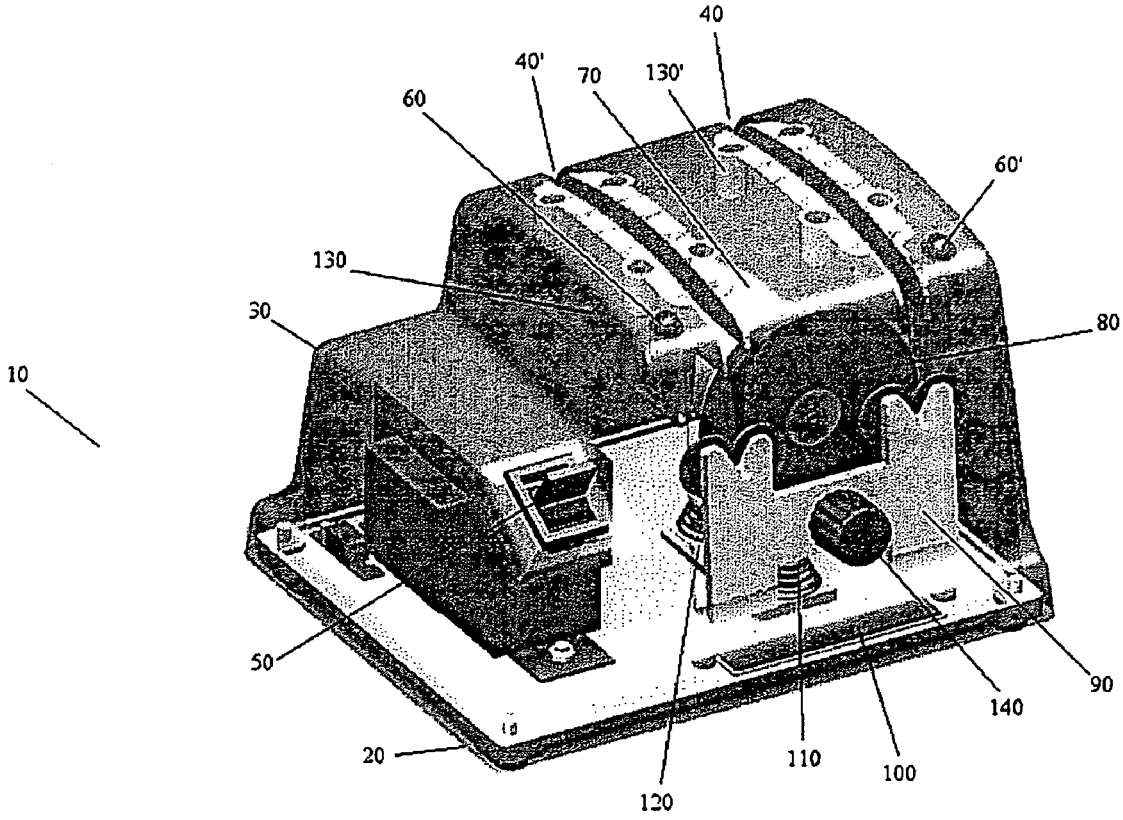
FIG. 1 is a perspective view of the sharpening-trimming assembly of the present invention.

As can be seen from FIG. 1, the inner and outer features of the sharpening-trimming assembly 10 of the present invention are shown for better viewing. Externally, the assembly 10 is comprised of a base 20 and a casing 30, as seen by the user of the assembly. As can be seen from said FIG. 1, the casing 30 has two insertion slots 40, 40', which receive the tool to be sharpened. In addition, at least one indicator means 60, 60' is provided on the casing 30, which is responsible for indicating the direction of motion of the grindstone. Preferably, two indicator means 60, 60' are provided. Such indicator means include audible, visual or any other kind of indicator means. For purposes of illustration, the indicator means may be a LED, which is driven by a switch 50.

The switch 50 serves to drive the inner engine 70, which, as a consequence, drives the grindstone 80 to proceed to sharpening. As mentioned earlier, the switch 50 also drives the indicator means 60, 60'. Such switch may be of the momentary type, i.e., it switches on only momentarily and while it is under control, of the on-off switch type, i.e., the switch needs a command to be switched on and a command to be switched off, among others. Preferably, the switch is of the momentary type, so that the engine does not become overheated and to avoid power waste. Obviously any other type of switch may be utilized by a person skilled in the art without departing from the scope of the present invention.

It should be noted that, as the engine 70 and the grindstone 80 may be driven by the switch 50, an alternative configuration is foreseen in which a sensing means is used that drives the engine and the grindstone through the presence of the tool to be sharpened.

The assembly 10 also has safety elements 130, 130' internally coupled to the insertion slots 40, 40'. Such protective safety elements 130, 130' prevent the tool to be sharpened from contacting the inner elements of the assembly 10 other than the grindstone 80, thereby protecting both the user and the assembly itself from occasional misuse.

In the front portion of the casing 30 a guide element assembly 90, 140 is additionally provided. The assembly is comprised of the inner guide 90 and the adjusting element 140. The guide element assembly 90, 140 is responsible for increasing/decreasing the part of the tool to come into contact with the grindstone 80, by changing the angle at which the tool strikes upon said grindstone. Such inner guide 90 has, in each of its ends, at least two discs 160, 160' overlapped such that the gap between them does not provide any surface. Thus, when the tool is inserted into the slot of the sharpening-trimming assembly, the front portion of the edge becomes flattened, since only the sides of the edge touch the discs 160, 160'.

Figure 2:
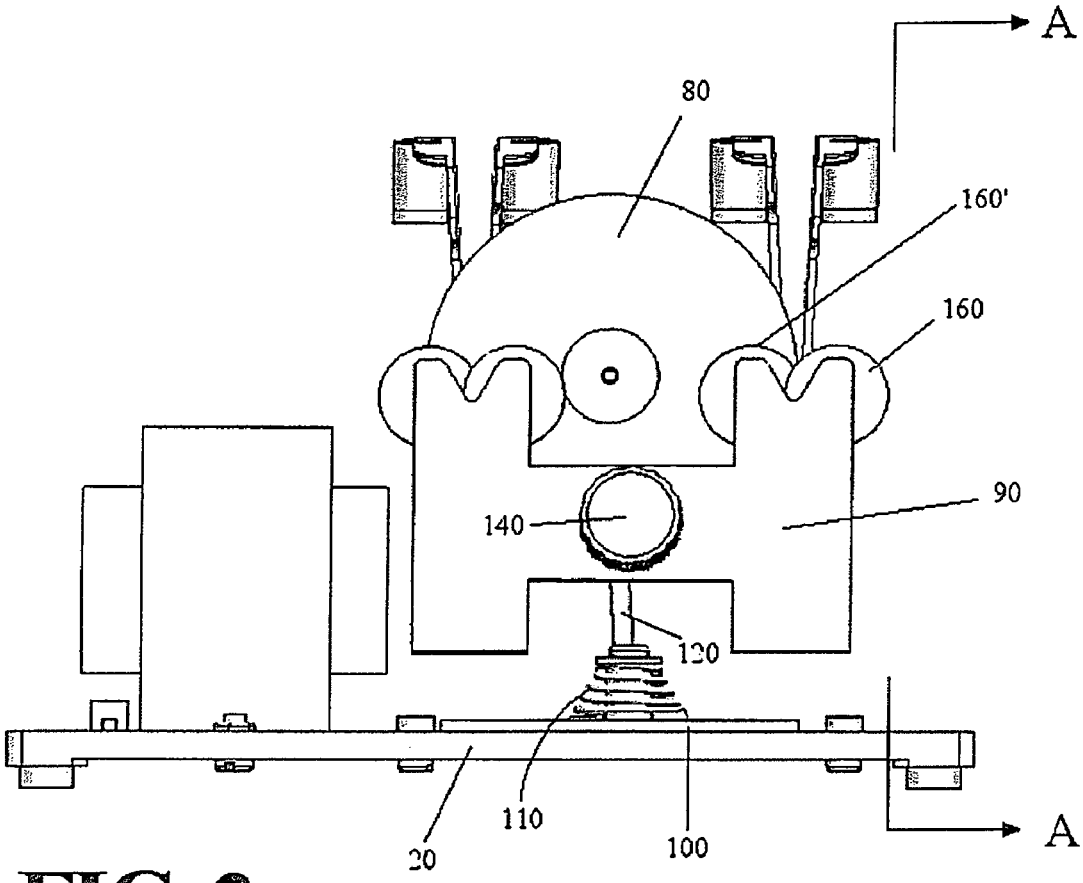
FIG. 2 is a front view of the sharpening-trimming of the present invention, open.

In FIG. 2, a rod 120 is shown connecting the engine 70 to base 20. However, the rod 120 of the present invention is connected to the base by at least one resilient element 110, rather than in a fixed manner. Thus, the rod overcomes the prior art problem, especially the rod from Patent Application PI 0400199-0, since, with the continued use of that assembly and the consequent flexing of the rod, this would remain permanently deformed. Also, the means 100 prevents the buildup of debris resulting from the sharpening action. Such means 100 holds the debris, preventing them from contacting the engine 70 and preventing the overheating thereof. Likewise, the means 100 prevents the buildup of debris throughout the length of base 20 of assembly 10, as well as preventing the debris from coming off, giving the assembly a full and continuous operation and keeping the working site in perfect conditions. Preferably, such means 100 is a magnetic bar that attracts the ferrous debris resulting from sharpening to it. However, any debris retaining element may be utilized with the present assembly.

As can also be gathered from FIG. 2, the guide element assembly 90, 140 is positioned ahead of grindstone 80, causing the angle of the tool to be sharpened to be changed by displacing the guide 90. The adjusting element 140 sets the position of guide 90 at the angle chosen by the user.

Figure 3:
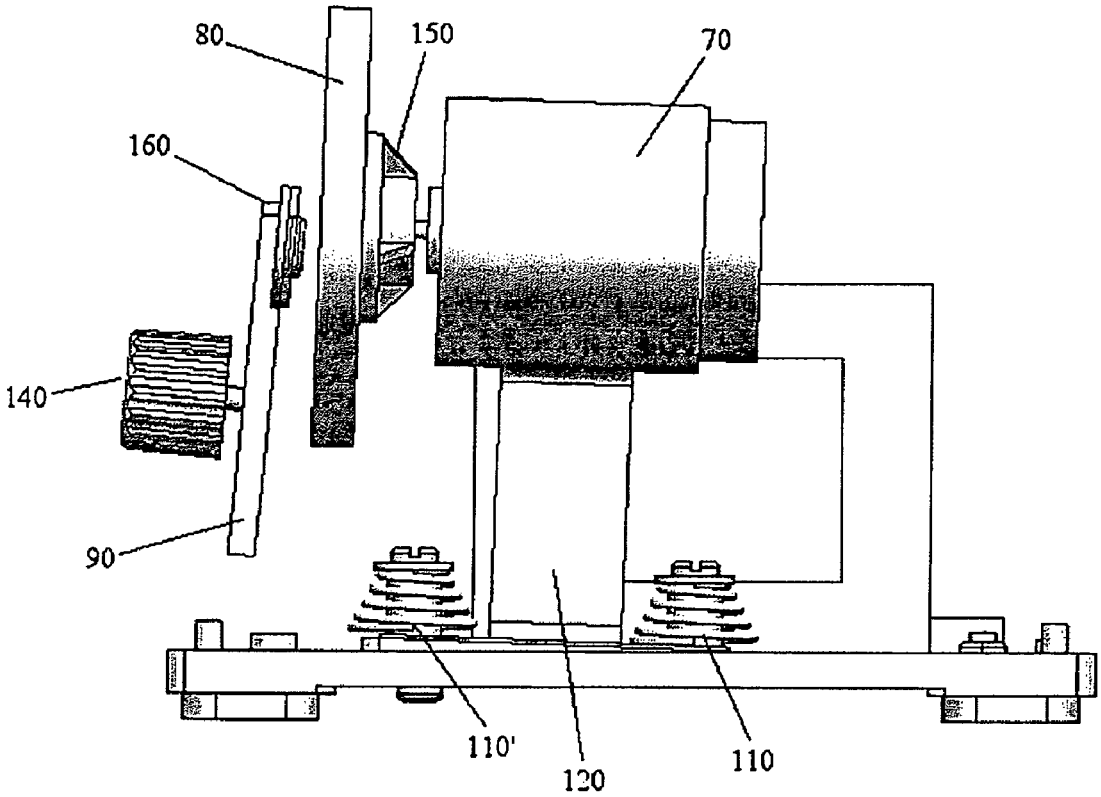
FIG. 3 is a side view of the sharpening-trimming of the present invention, open, showing the cross-section, as indicated by line A—A in FIG. 2.

From FIG. 3, the operation of moveable rod 120 becomes clear. Said rod moves by the action of at least one resilient element 110, 110'. It is worth pointing out that, by way of example, the moveable rod 120 has a rectangular base. Thus, as illustrated, two resilient elements 110, 110' have been required. However, it is obvious that, where the rod base is circular, only a resilient element 110 would be required.

Therefore, as the user approaches the tool to the grindstone 80 surface, by exerting a certain pressure against it, the moveable rod 120 flex under the action of resilient elements 110, 110'. The elements 110, 110' have a sufficient resiliency to allow the moveable rod to flex in a predetermined displacement, without, however, giving the rod an overflexing. This is due to the fact that an overflexing of the rod 120 may cause the grindstone 80 to contact the safety elements 130, 130'.

As can be understood, when in the position of sharpening a tool, the grindstone 80 may flex both to the right and the left to the vertical axis, by means of moveable rod 120, resulting in a small pressure by the grindstone 80 on the cutting surface of the object to be sharpened, thus avoiding an abrasive overload and providing a gentle and even sharpening along the entire said cutting surface.

Upon inserting the tool into slot 40, 40', the grindstone 80 is displaced in opposition to the slot into which the tool has been inserted, thereby undergoing the action of a force opposed to the action of inserting the tool, achieved by the flexing of rod 120 and resilient elements 110, 110'.

The tool to be sharpened comes into contact with the grindstone 80 through slots 40, 40', which have a predetermined angling, receiving, when touching the grindstone, a slight pressure which is the result of the flexing of moveable rod 120 connected to grindstone 80 through engine 70. If necessary, the user may also use said guide element assembly 90, 140 in order to change the striking angle of grindstone 80, whether as a result of the grindstone wear or by preferring a certain sharpening and/or trimming angling.

This is sufficient for a perfect and even sharpening on the entire cutting surface of the tool, an essential factor for achieving an accurate cutting operation, that is, a cutting performed in a certain location, at the desired depth and thickness, with a minimum of effort or pressure on the tool and with perfection, that is, an operation in which the fibers of the material are effectively cut rather than torn or shred.

Thus, in order for the tool to be sharpened to effect an optimized cutting operation, the cutting edge should get a good sharpening, kept as needed for use, thereby maintaining the tool cutting ability.

The edge of a cutting tool is defined by the sharpening angle. The smaller the angle, the greater the cutting power of the tool, but the edge serviceability will be compromised by possible folds and even breaks. As is known in the art, sharpening angles from 17 to 20 degrees are deemed to be ideal for knives for cutting meat and filleting fish.

It is not the aim of the present invention to determine the sharpening angle to be used in an tool, but to provide a sharpening-trimming assembly having a single grindstone connected to a moveable rod with resilient elements, where the slots for the insertion of tools have predetermined angles to facilitate sharpening, and the grindstone and moveable rod assembly acts to slightly press the grindstone upon the cutting surface of the tool, optimizing the trimming of the fibers of the material to be sharpened. However, the assembly allows the user to change the sharpening angle by means of the guide element assembly.

FIG. 3 also shows that the grindstone 80 is designed with a reduced thickness, which allows an extra ventilating element 150 comprised of vanes to be incorporated. Thus, with the motion of grindstone 80 and, consequently, of ventilating element 150, the vanes cool the engine 70 connected to grindstone 80, thereby preventing the overheating of the sharpening-trimming assembly 10.

Therefore, in view of the above, with the apparatus of the present invention, a careless user will not have problems with the rotational motion of grindstone 80, since this is not accessible to the user when in the operating position. The insertion slots 40, 40' have an ideal angling to provide an optimal sharpening, while not excessively wearing the tool to be sharpened, being aided by the guide element assembly 90, 140.

The slots 40, 40' associated with the protective elements 130, 130' provide the user an extra safety by preventing the tool from being improperly inserted into the assembly and reaching the inner elements thereof. It is obvious that the assembly may have a variable width slot that will likewise vary according to the width of the tool to be sharpened.

Although the above description refers to a preferred embodiment, it should be understood by those skilled in the art that the present invention is not limited to the details of the above teachings.

It should be noted that variations, modifications and changes to the invention herein described are possible for those skilled in the art, without departing from the spirit and scope of the present invention or its equivalents, as embraced by the appended claims and their equivalents.

The invention claimed is:

1. A sharpening-trimming assembly, comprising:

a base;

a casing mounted on said base;

the casing having at least two insertion slots provided on the upper portion of the casing for receiving the tool to be sharpened;

the sharpening-trimming assembly being characterized by further comprising:

a moveable rod (120) connecting the base (20) to an engine (70) by means of at least one resilient element (110, 110');

a grindstone (80) fixed to and operable by said engine (70) forming an unit moveable by the action of the moveable rod (120) and the resilient element (110, 110');

the rod being able to flex to the vertical axis thereof by the action of resilient element (110, 110') in conjunction with the tool to be sharpened contacting the surface of grindstone (80) upon the insertion of the tool into one of said at least two insertion slots (40, 40') of the casing (30); and the insertion slots (40, 40') having a predetermined angling for receiving the tool to be sharpened.

2. A sharpening-trimming assembly of claim 1, characterized in that it further comprises:

a guide element assembly (90, 140) to change the predetermined angling of the insertion slots (40, 40') consisting of an inner guide (90) and an adjusting element (140), the inner guide having, in each of its ends, at least two discs (160, 160').

3. Sharpening-trimming assembly of claim 1 or 2, characterized in that it further comprises:

safety elements (130, 130') internally coupled to the insertion slots (40, 40').

4. Sharpening-trimming assembly of any of claims 1 to 3, characterized in that it further comprises:

a switch (50) for driving the engine (70), and thus the grindstone (80).

5. Sharpening-trimming assembly of any of claims 1 to 3, characterized in that it further comprises:

a sensing means for driving the engine (70) and, consequently, the grindstone (80), through the presence of the tool to be sharpened.

6. Sharpening-trimming assembly of any of claims 1 to 5, characterized in that it further comprises:

a means (100) for preventing the buildup of debris resulting from sharpening.

7. Sharpening-trimming assembly of any of claims 1 to 6, characterized in that it further comprises:

at least one indicator means (60, 60') for indicating the direction of motion of the grindstone.

8. Sharpening-trimming assembly of any of claims 1 to 7, characterized in that:

the grindstone (80) is designed with a ventilating element (150) in the rear portion thereof.

9. Sharpening-trimming assembly of any of claims 1 to 8, characterized in that the insertion slots (40, 40') are provided with different opening widths for the sharpening of tools of various types and shapes.

* * * * *